US009293249B2

(12) United States Patent
Ellison et al.

(10) Patent No.: US 9,293,249 B2
(45) Date of Patent: Mar. 22, 2016

(54) MOTORCYCLE IGNITION COIL ASSEMBLY

(71) Applicant: Accel Performance Group LLC, Cleveland, OH (US)

(72) Inventors: Jason Ellison, Elyria, OH (US); Jon Arotzarena, Parma, OH (US)

(73) Assignee: Accel Performance Group LLC, Cleveland, OH (US)

( * ) Notice: Subject to any disclaimer, the term of this patent is extended or adjusted under 35 U.S.C. 154(b) by 194 days.

(21) Appl. No.: 14/170,538

(22) Filed: Jan. 31, 2014

(65) Prior Publication Data

US 2014/0209077 A1 Jul. 31, 2014

Related U.S. Application Data

(60) Provisional application No. 61/758,929, filed on Jan. 31, 2013.

(51) Int. Cl.

| | |
|---|---|
| ***H01F 38/12*** | (2006.01) |
| ***F02P 13/00*** | (2006.01) |
| ***F02P 15/00*** | (2006.01) |
| *F02P 3/02* | (2006.01) |

(Continued)

(52) U.S. Cl.

CPC ..... *H01F 38/12* (2013.01); *F02P 13/00* (2013.01); *F02P 15/001* (2013.01); *F02B 61/02* (2013.01); *F02B 75/22* (2013.01); *F02P 3/02* (2013.01)

(58) Field of Classification Search

CPC . H01F 38/12; H01F 2038/122; H01F 17/045; F02P 3/02; F02P 7/026; F02P 15/001; F02P 13/00; F01P 1/02; F01P 2001/026; F01P 1/06; F01P 1/10

USPC ..... 123/634, 635, 644; 336/221

See application file for complete search history.

(56) References Cited

U.S. PATENT DOCUMENTS

| | | | | |
|---|---|---|---|---|
| 7,117,860 | B1 * | 10/2006 | Chittum | 123/635 |
| 2009/0194083 | A1 | 8/2009 | Boerjes | |

FOREIGN PATENT DOCUMENTS

| | | | |
|---|---|---|---|
| CN | 102061974 | A | 5/2011 |
| GB | 708559 | A | 5/1954 |
| GB | 734945 | A | 8/1955 |

(Continued)

OTHER PUBLICATIONS

International Search Report and Written Opinion for International Application No. PCT/US2014/014205, mailed May 27, 2014, 11 pages.

(Continued)

*Primary Examiner* — Hung Q Nguyen
*Assistant Examiner* — Omar Morales
(74) *Attorney, Agent, or Firm* — Standley Law Group LLP

(57) ABSTRACT

In accordance with one embodiment, an ignition coil assembly includes an ignition coil cover, a boot, and an ignition coil. The ignition coil cover includes a plurality of fins, an opening, and a channel. The boot includes a slotted opening and a centralized orifice and is configured to be disposed within the opening of the ignition coil cover. The ignition coil includes a seat and a tab. The ignition coil is configured to be disposed within the centralized orifice. The seat is capable of supporting the ignition coil within the centralized orifice of the boot. The tab is configured to be inserted into the slotted opening and the channel when the ignition coil is disposed within the centralized office and the boot is disposed within the opening.

6 Claims, 7 Drawing Sheets

(51) Int. Cl.
*F02B 75/22* (2006.01)
*F02B 61/02* (2006.01)

(56) References Cited

FOREIGN PATENT DOCUMENTS

GB 821015 A 9/1959
JP 2000045860 A 2/2000

OTHER PUBLICATIONS

Ducati: "Multistrada 1200 ABS—Model Year 2010—Spare parts catalogue No. 915.1.301.1A," retrieved on Nov. 12, 2014 from http://www.ducati.at/uploads/media/MTS1200SABS_Eu_2010.pdf. pp. 78 and 134; Figures 18b (A) and 031, 2 pages.

* cited by examiner

MOTORCYCLE IGNITION COIL ASSEMBLY

RELATED APPLICATIONS

This application claims the priority of U.S. Provisional Patent Application Ser. No. 61/758,929 filed Jan. 31, 2013, the entire disclosure of which is specifically incorporated herein by reference.

FIELD OF INVENTION

The present disclosure relates to an ignition coil assembly. More particularly, the present disclosure relates to an ignition coil assembly for use with an internal combustion engine of a motorcycle.

BACKGROUND

Ignition coils are systems attached to or integrated with internal combustion engines used with vehicles such as automobiles and motorcycles. Ignition coils are induction coils that cooperate with a vehicle's battery to provide the energy required to power spark plugs. Specifically, the ignition coil typically converts relatively low voltage current from the vehicle's battery to the high voltage current required to generate a spark from the spark plug that ignites the air-fuel mixture within the internal combustion engine.

Ignition coil systems for motorcycles commonly include the ignition coil being positioned remotely from the spark plugs. Typically ignition coils are connected to the spark plugs by high-voltage insulated ignition wires that run from one location on the engine (i.e., the location of the ignition coil) to another location on the engine (i.e., the location of the spark plugs). Such an arrangement can cause clutter in and around the engine, expose the ignition wires to potentially harsh environments, and lead to sub-optimal performance of the ignition system and engine.

SUMMARY

In accordance with one embodiment, an ignition coil assembly includes an ignition coil cover, a boot, and an ignition coil. The ignition coil cover includes a plurality of fins, an opening, and a channel. The boot includes a slotted opening and a centralized orifice and is configured to be disposed within the opening of the ignition coil cover. The ignition coil includes a seat and a tab. The ignition coil is configured to be disposed within the centralized orifice. The seat is capable of supporting the ignition coil within the centralized orifice of the boot. The tab is configured to be inserted into the slotted opening and the channel when the ignition coil is disposed within the centralized office and the boot is disposed within the opening.

BRIEF DESCRIPTION OF THE DRAWINGS

In the accompanying drawings, structures are illustrated that, together with the detailed description provided below, describe exemplary embodiments of the claimed invention. Like elements may be identified with the same reference numerals for convenience. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

The apparatuses and methods disclosed in this document are described in detail by way of examples and with reference to the figures. It will be appreciated that modifications to disclosed and described examples, arrangements, configurations, components, elements, apparatuses, methods, materials, etc. can be made and may be desired for a specific application. In this disclosure, any identification of specific shapes, materials, techniques, arrangements, etc. are either related to a specific example presented or are merely a general description of such a shape, material, technique, arrangement, etc. Identifications of specific details or examples are not intended to be and should not be construed as mandatory or limiting unless specifically designated as such. Selected examples of ignition coil assemblies are hereinafter disclosed and described in detail with reference made to figures.

Disclosed herein are exemplary embodiments of ignition coil assemblies including examples of such ignition coil assemblies where an ignition coil assembly can be directly mounted proximate to the spark plugs of an engine such that the need for ignition wires is eliminated. Ignition coil assemblies mounted proximate to the spark plugs can reduce current leakage and reduce electronic interference. In one exemplary application, ignition coil assemblies as described and disclosed herein can be arranged for use with motorcycle engines such as, for example, air cooled v-twin engines.

Figure 1:
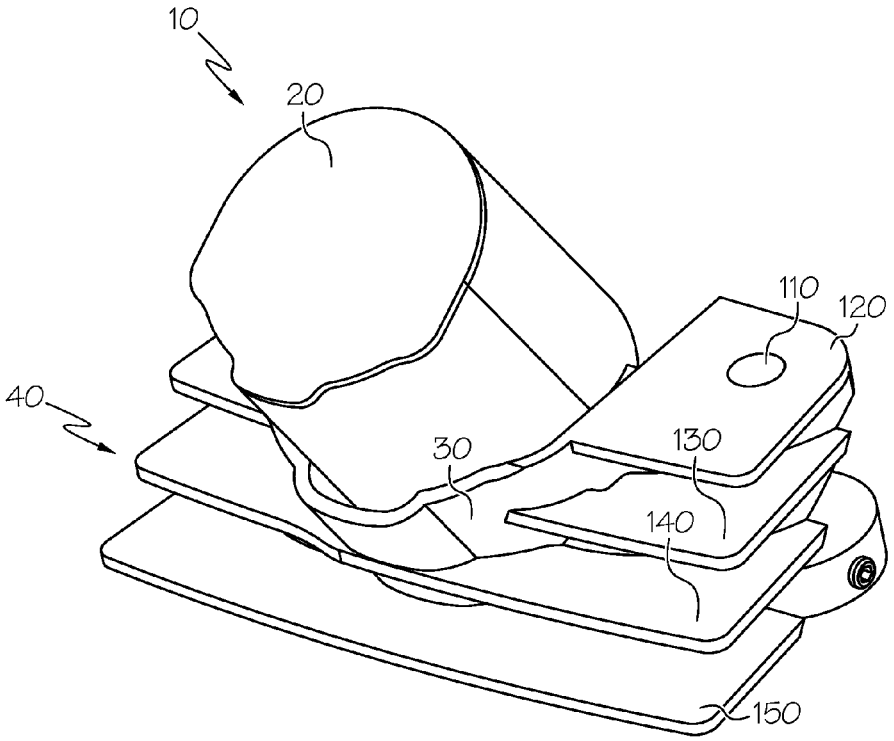
FIG. 1 is a front perspective view of one embodiment of the ignition coil assembly.
Figure 2:
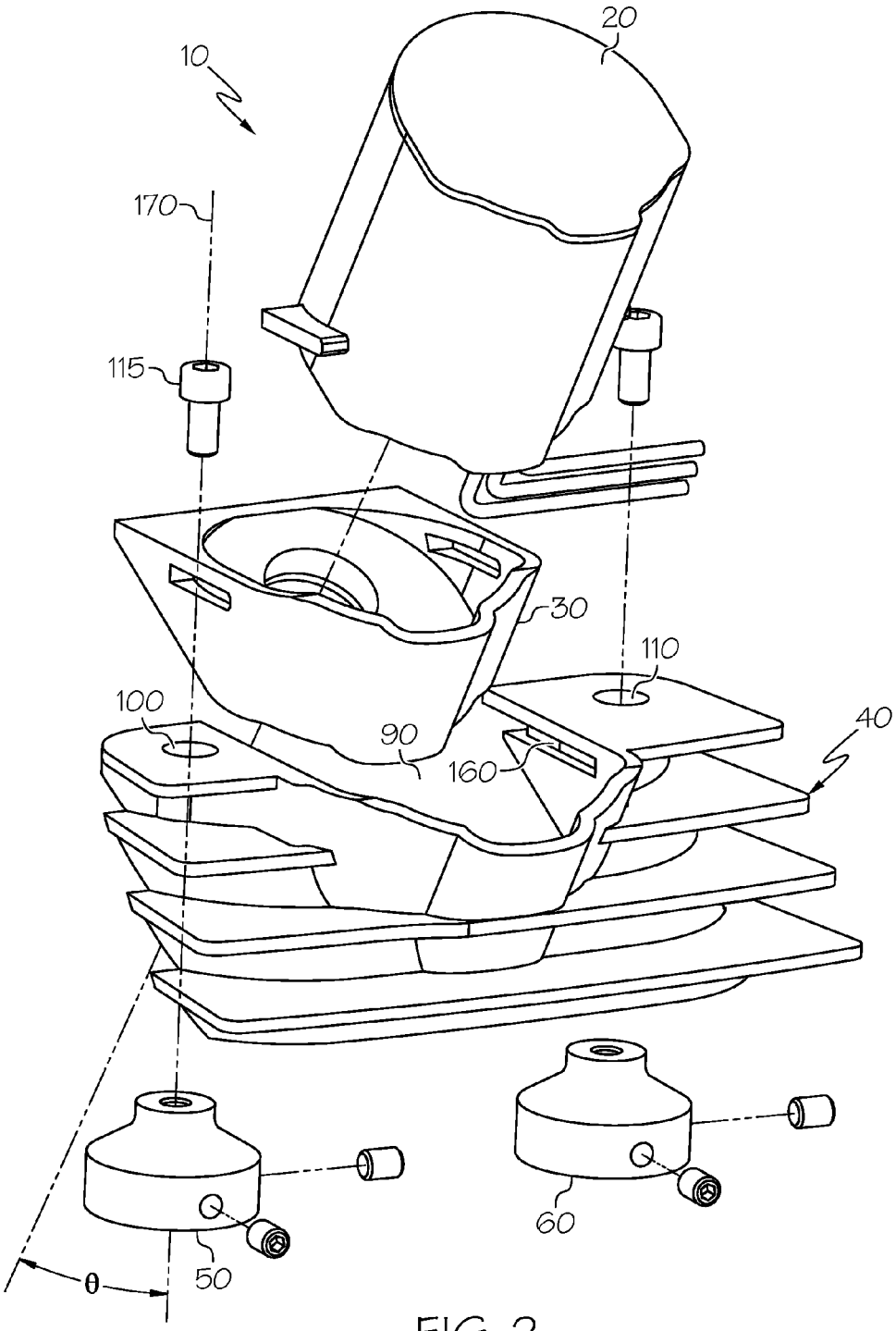
FIG. 2 is a exploded view of one embodiment of the ignition coil assembly.
Figure 3:
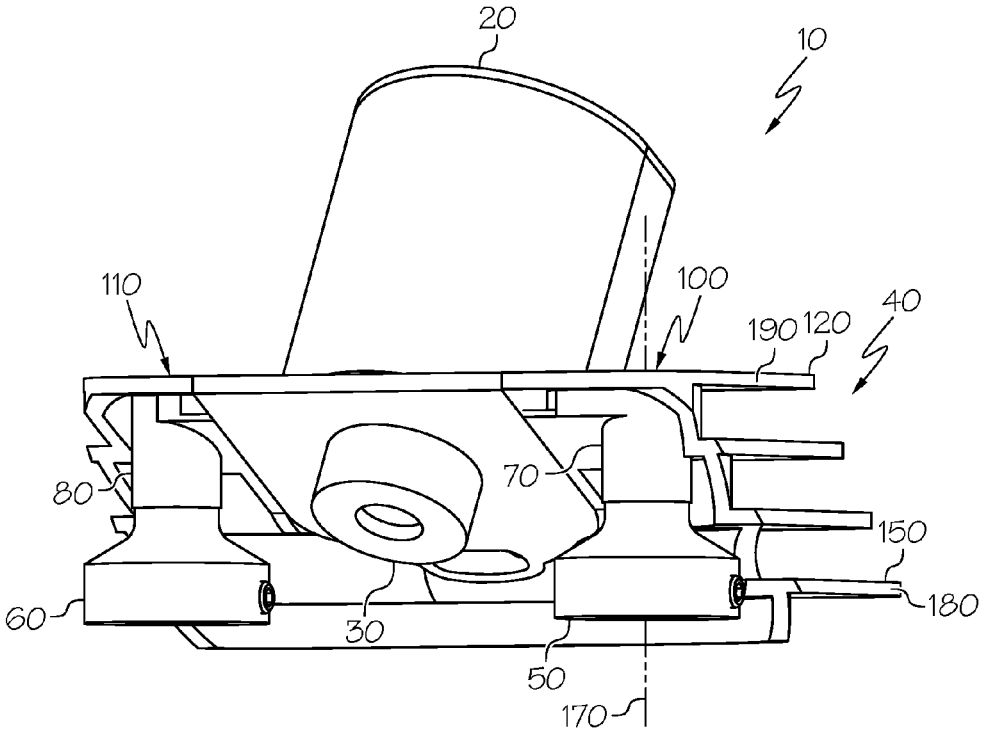
FIG. 3 is a rear perspective view of one embodiment of the ignition coil assembly

FIGS. 1-3 illustrate an exemplary embodiment of an ignition coil assembly 10. The ignition coil assembly 10 includes an ignition coil 20, a boot 30, an ignition coil cover 40, a pair of mounts 50, 60, and a pair of posts 70, 80. The ignition coil 20 and boot 30 can be arranged so that the ignition coil 20 and boot 30 can cooperatively engage. For example, the ignition coil 20 can be arranged so that the ignition coil 20 can be inserted or otherwise positioned within the boot 30. In one example, as illustrated in the exploded view of FIG. 2, a portion of the ignition coil 20 can have a generally cylindrical outer shape, and a portion of the boot 30 can have a generally cylindrical inner shape. Therefore, the generally cylindrical outer shape portion of the ignition coil 20 can be inserted into and engage with the generally cylindrical inner shape portion of boot 30.

The boot 30 and ignition coil cover 40 can be arranged to cooperatively engage. In one example, the ignition coil cover 40 can include an opening 90 that accommodates the boot 30. As illustrated in exploded view of FIG. 2, in one embodiment, the opening 90 can be arranged as a generally u-shaped opening, and the boot 30 can be arranged so that a portion of the boot 30 fits within the generally u-shaped opening 90, where a portion of the exterior surface of the boot 30 engaging a portion of the perimeter of the u-shaped opening 90. Although the opening 90 of the ignition coil cover 40 is described and illustrated as u-shaped, it will be understood that the opening can be arranged in any number of other shapes and proportions necessary to receive the boot 30. For example, the opening can be, without limitation, square, round, angular or any other geometric shape necessary to receive a boot.

The mounts 50, 60 and the posts 70, 80 can be arranged to be utilized cooperatively to discreetly and directly secure the ignition coil system 10 to an engine of a motorcycle in a position proximate to the spark plugs. Such positioning can result in the elimination of any exterior wiring from the ignition coil to the engine's spark plugs. As illustrated in FIG. 3, the ignition coil cover 40 can include a first aperture 100 and a second aperture 110. One end of a first post 70 can be secured to the ignition coil cover 40 via the first aperture 100, and one end of a second post 80 can be secured to the ignition coil cover 40 via the second aperture 110. Another end of the first post 70 can be secured to a first mount 50, and another end of the second post 80 can be secured to a second mount 60. As will be understood, the first and second posts 70, 80 can be secured to the ignition coil cover by a fastener such as a bolt 115 (as illustrated in FIG. 2). As will be further described herein, the first and second mounts 50, 60 can be secured to an engine, thus, securing the ignition coil assembly 10 to the engine.

Figure 4:
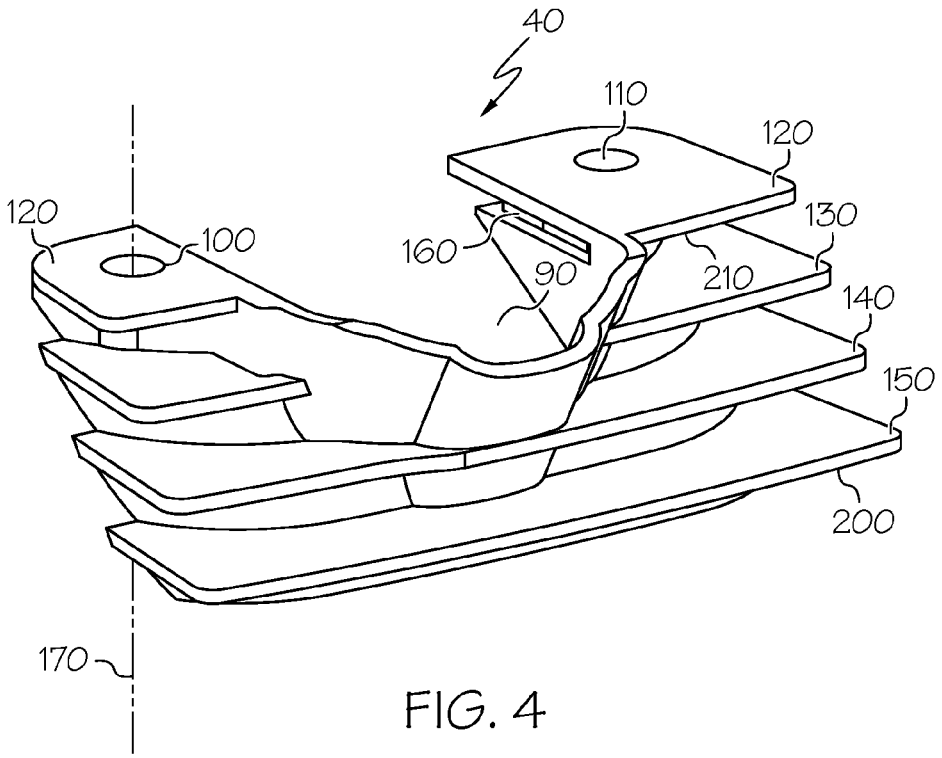
FIG. 4 is a detailed front perspective view of one embodiment of an ignition coil cover used in the ignition coil assembly.

FIG. 4 illustrates an exemplary embodiment of the ignition coil cover 40. The ignition coil cover 40 can include a plurality of fins. For example, in the embodiment illustrated in FIG. 4, the ignition coil cover 40 includes a top fin 120, a pair of intermediate fins 130, 140, and a bottom fin 150. The top fin 120 is arranged as two segments. It will be understood that in the embodiment as shown in FIG. 4, the top fin 120 is arranged in two segments to accommodate the boot 30 as it engages the opening 90 upon assembly of the ignition coil assembly 10. Although the embodiment of FIG. 4 illustrates an ignition coil cover 40 with four fins, it will be understood that an ignition coil cover can be arranged to have more than four or less than four fins.

As previously discussed, the ignition coil cover 40 can include an opening 90 and a pair of apertures 100, 110. Furthermore, the ignition coil cover 40 can include at least one channel 160. The at least one channel 160 can be positioned in the top fin 120. Although only one channel 160 is illustrated in FIG. 4, it will be understood that more than one channel can be positioned in the top fin 120. For example a second channel can be positioned opposite the illustrated channel 160 so that one channel is positioned in each of the two segments of the top fin 120, and each channel is exposed to the opening 90 of the ignition coil cover 40.

In the embodiment illustrated in FIG. 4, the fins 120, 130, 140, 150 can be arranged as generally planar and parallel fins. Furthermore, the fins 120, 130, 140, 150 can be generally arranged horizontally. It will be understood that the fins 120, 130, 140, 150 can also be arranged in other relative configurations. For example, the fins 120, 130, 140, 150 can be arranged vertically, diagonally, or in any other suitable arrangement. In one embodiment, the fins 120, 130, 140, 150 of the ignition coil cover 40 are arranged so as to correspond to or match the configuration of the fins of an air cooled v-twin motorcycle engine. Correspondingly, in other embodiments, the fins 120, 130, 140, 150 of the ignition coil cover 40 can be arranged so as to correspond to or match the configuration of the fins of any type of engine.

The fins 120, 130, 140, 150 can be aligned in a stadium style arrangement. This is to say that the each fin extends further forward and/or to the side than the fin above. An example of a stadium style arrangement is illustrated in FIGS. 3 and 4, and will be described in reference to a central axis 170 passing through the first aperture 100 and first post 70. With reference to FIG. 3, in a stadium style arrangement the distance between the central axis 170 and a side edge 180 of the bottom fin 150 is greater than the distance between the center axis 170 and a side edge 190 of the top fin 120. With reference to FIG. 4, in a stadium style arrangement the distance between the central axis 170 and a front edge 200 of the bottom fin 150 is greater than the distance between the center axis 170 and a front edge 210 of the top fin 120.

In one embodiment, the posts 70, 80 are generally disposed on opposing sides of the opening 90 and abut the underside of the top fin 120. In another example, the posts 70, 80 can abut any of the plurality fins 120, 130, 140, 150 of the ignition coil cover 40. In one embodiment, each post 70, 80 is substantially vertical and has a central axis 170 that is substantially perpendicular to the plurality of horizontal fins 120, 130, 140, 150. Alternatively, the posts 70, 80 can be oriented at an angle with reference to the horizontal fins 120, 130, 140, 150. One of ordinary skill in the art upon reading this disclosure would recognize that posts can be located elsewhere in the ignition coil assembly 10, including without limitation, the boot 30 or the ignition coil 20. In yet another embodiment posts may be omitted altogether.

Although the ignition coil assembly 10 is illustrated with the ignition coil cover 40 having a pair of apertures 100, 110, a pair of corresponding posts 70, 80, and corresponding mounts 70, 80 disposed on either side of the opening 90, it will be understood that an ignition coil assemblies can include other quantities and arrangements of apertures, posts and mounts. For example an ignition coil assembly may include more or less than two apertures, posts, and/or mounts. The functions performed by the mounts and posts can be served by a single component instead of individual components.

Figure 5:
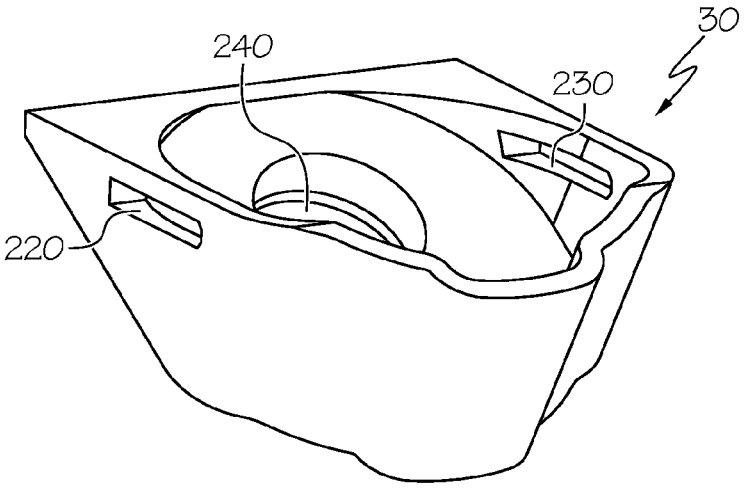
FIG. 5 is a perspective view of a boot used in one embodiment of the ignition coil assembly.
Figure 6:
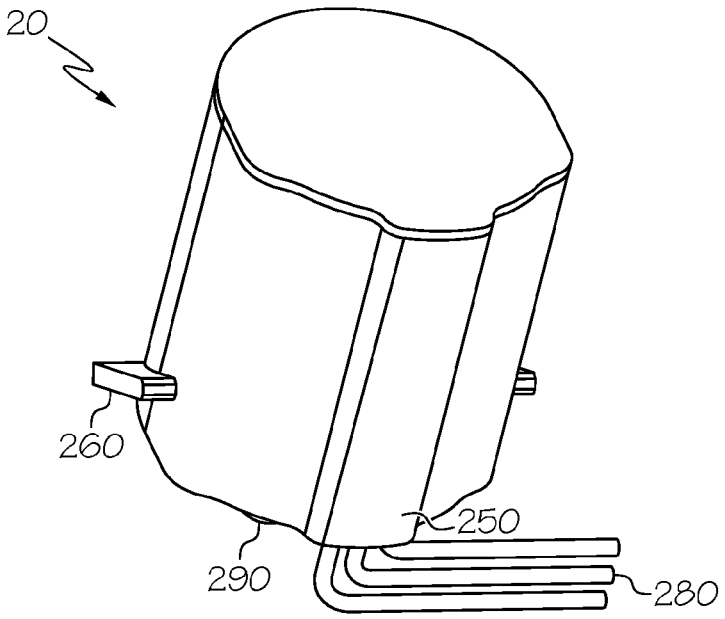
FIG. 6 is a perspective view of an ignition coil used in one embodiment of the ignition coil assembly.
Figure 7:
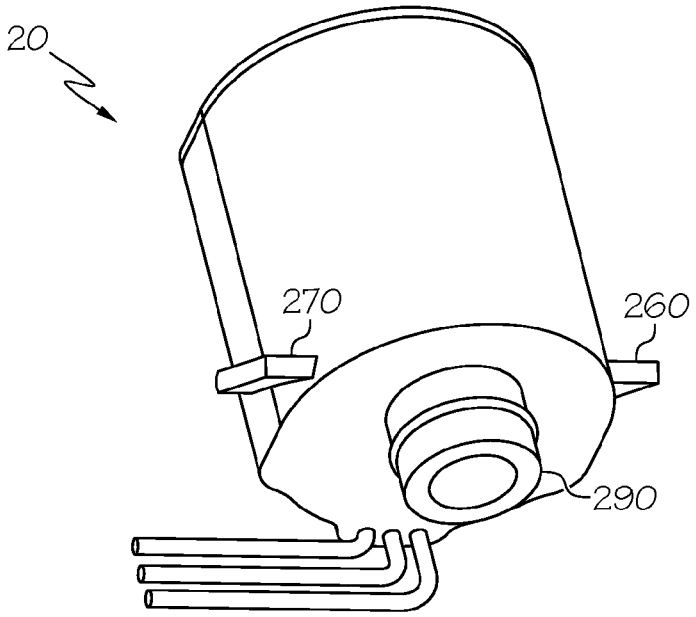
FIG. 7 is a perspective view of an ignition coil used in one embodiment of the ignition coil assembly.

FIG. 5 illustrates an exemplary embodiment of a boot 30, and FIGS. 6 and 7 illustrate an exemplary embedment of an ignition coil 20. The ignition coil 20, the boot 30 and the ignition coil cover 40 can be arranged so that the ignition coil 20 and the boot 30 engage via a snap-fit arrangement; and, furthermore, the assembly of the ignition coil 20 and the boot 30 engage the ignition coil cover 40 via a snap-fit arrangement. As noted above, the ignition coil cover 40 includes at least one channel 160, and in an embodiment, the ignition coil cover 40 includes two channels 160. As illustrated in FIG. 5, the boot 30 can include two slotted openings 220, 230 positioned on either side of a centralized orifice 240. The centralized orifice 240 is arranged to support the ignition coil 20.

As illustrated in FIGS. 6 and 7, the ignition coil 20 includes a seat 250 for supporting the ignition coil 20 within the centralized orifice 240 of the boot 30. The ignition coil 20 further includes two tabs 260, 270 on opposing sides of the ignition coil 20. The tabs 260, 270 are dimensioned to be insertable into the slotted openings 220, 230 on either side of the boot 30 so as to secure the ignition coil 20 to the boot 30. The ignition coil 20 can further include at least one wire 280 and a plug receptor 290 disposed at a distal end of the ignition coil 20. The plug receptor 290 can be electrically connected to a spark plug (not shown).

Figure 8:
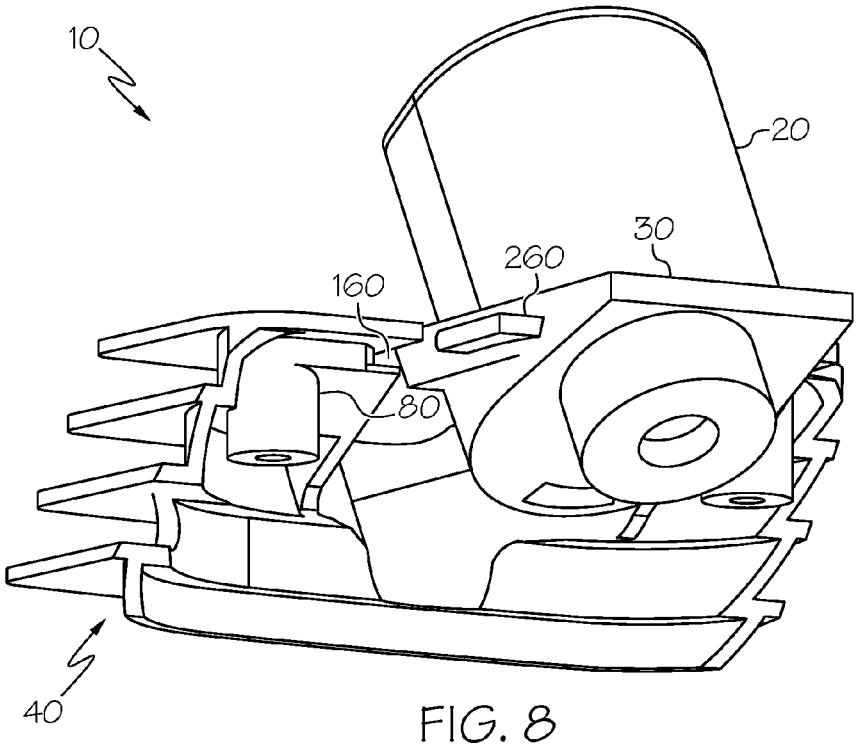
FIG. 8 is a rear perspective view of one embodiment of an ignition coil assembly showing the boot and ignition coil disengaged from the ignition coil cover.
Figure 9:
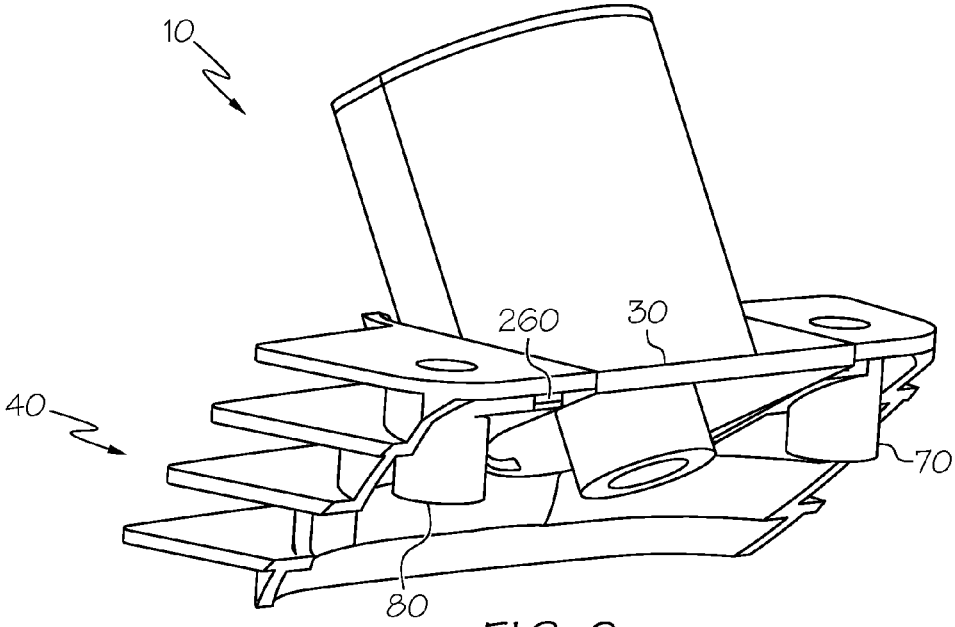
FIG. 9 is a rear perspective view of one embodiment of the ignition coil assembly showing the boot and ignition coil engaged with the ignition coil cover.

FIGS. 8 and 9 illustrate a rear view of an assembly of the ignition coil 20, boot 30, and ignition coil cover 40. As discussed previously and as illustrated in FIG. 3, the ignition coil cover 40 can include channels 160 that are configured to attach the boot 30 and the ignition coil 20 to the ignition coil cover 40. Channels 160 can be arranged on either side of the opening 90 of the ignition coil cover 40 and arranged and dimensioned to receive the tabs 260, 270 located on either side of the ignition coil 20. In such an embodiment, when the ignition coil 20 is assembled with the boot 30, the tabs 260, 270 protrude through the slotted openings 220, 230 of the boot 30. As illustrated in FIGS. 8 and 9, the tabs 260, 270 not only secure the ignition coil 20 to the boot 30 by engaging the slotting openings 220, 230, but also secure the assembly of the ignition coil 20 and the boot 30 to the ignition coil cover 40 by further engaging the channels 160 of the ignition coil cover. It will be understood that the ignition coil 20 and/or boot 30 can alternatively be secured in the channels 160 in any number of ways, including without limitation, snapping, molding, interlocking, screwing, and equivalents thereof.

Referring again to FIG. 2, the ignition coil 20 can be snap-fitted to the boot 30 and the ignition coil cover 40 at an angle (θ) that is less than 90 degrees with respect to the central axis 170 through the first aperture 100 and the first post 70. In alternative embodiments, the ignition coil 20 may be disposed in the boot 30 and the ignition coil cover 40 at an angle that is equal to or greater than 90 degrees with respect to the central axis 170.

Figure 10:
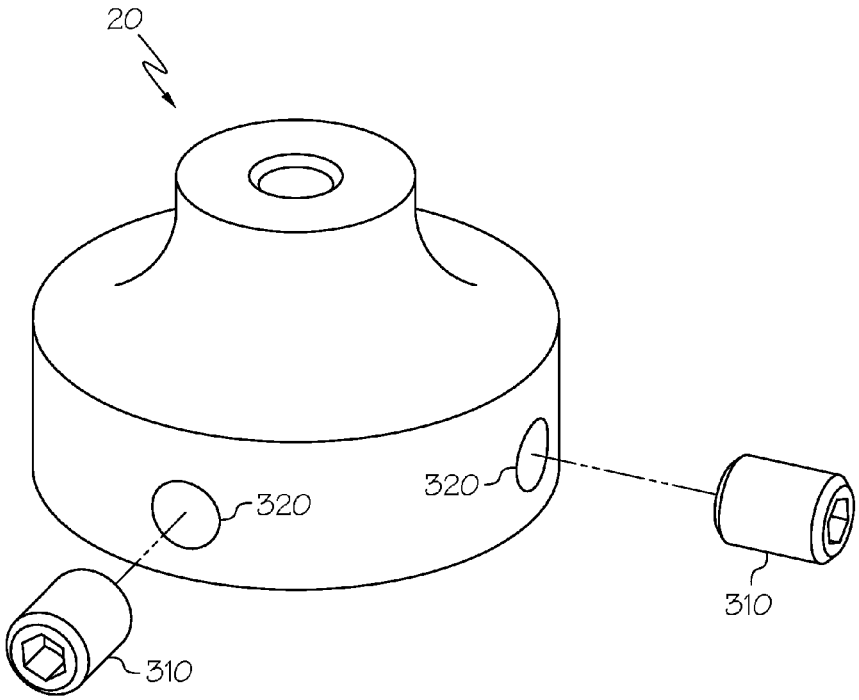
FIG. 10 is a perspective view of a mount used in one embodiment of the ignition coil assembly.

As shown in FIG. 10, a mount 50 of the ignition coil assembly 10 can be dimensioned to receive a post 70. The mount 50 can be used to attach the ignition coil assembly 10 to an engine by one or more attachment member 310 passing through one or more apertures 320. The attachment member 310 may be a bolt, screw, rivet, nail, weld, tie, or any fastener, and equivalents thereof. Alternatively, the mount 50 can be secured to the engine with an adhesive or other suitable method of attachment.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present disclosure has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the disclosure, in its broader aspects, is not limited to the specific details, the representative apparatus and method, and illustrative examples shown and described. Accordingly, departures may be made from such details without departing from the spirit or scope of the applicant's general inventive concept.

The foregoing description of examples has been presented for purposes of illustration and description. It is not intended to be exhaustive or limiting to the forms described. Numerous modifications are possible in light of the above teachings. Some of those modifications have been discussed, and others will be understood by those skilled in the art. The examples were chosen and described in order to best illustrate principles of various examples as are suited to particular uses contemplated. The scope is, of course, not limited to the examples set forth herein, but can be employed in any number of applications and equivalent devices by those of ordinary skill in the art.

What is claimed is:

1. An ignition coil assembly comprising:

an ignition coil cover comprising an opening, at least one channel, and a plurality of fins;

a boot comprising at least one slotted opening and a centralized orifice, and configured to be disposed within the opening of the ignition coil cover; and an ignition coil configured to be disposed within the centralized orifice of the boot and comprising at least one tab configured to be inserted into the slotted opening and the channel when the ignition coil is disposed within the centralized orifice and the boot is disposed within the opening of the ignition coil cover.

2. The ignition coil assembly of claim 1, further comprising at least one post attached to a top fin of the plurality of fins and at least one aperture in the top fin.

3. The ignition coil assembly of claim 2, further wherein a central axis of the at least one post is substantially perpendicular to the plurality of fins.

4. The ignition coil assembly of claim 3, where the ignition coil further comprising a seat capable of supporting the ignition coil within the centralized orifice of the boot.

5. The ignition coil assembly of claim 4, further comprising at least one mount attached to the at least one post.

6. The ignition coil assembly of claim 4, wherein the fins are aligned in a stadium style arrangement.

* * * * *